United States Patent [19]

Katzman

[11] 3,999,711

[45] Dec. 28, 1976

[54] ROTARY WATER SPRINKLER

[75] Inventor: Oded Katzman, Kiryat Haim, Israel

[73] Assignee: Mifal Leyitzur Mamtirim Veavizarei Hashkaya Bekibbutz Dan, Kibbutz Dan, Israel

[22] Filed: Nov. 26, 1975

[21] Appl. No.: 635,516

Related U.S. Application Data

[63] Continuation of Ser. No. 533,581, Dec. 17, 1974, abandoned.

[30] Foreign Application Priority Data

| | | |
|---|---|---|
| Dec. 27, 1973 | Israel | 43923 |
| May 17, 1974 | Israel | 44848 |
| Aug. 12, 1974 | Israel | 45457 |

[52] U.S. Cl. ..... 239/230; 239/262

[51] Int. Cl.[2] ..... B05B 3/08

[58] Field of Search ..... 239/203–206, 239/225, 257, 262, 230, 233, 454, 464, 570, 533

[56] References Cited

UNITED STATES PATENTS

| | | | |
|---|---|---|---|
| 2,176,243 | 10/1939 | Braungart | 239/262 X |
| 2,336,725 | 12/1943 | Engelhart | 239/262 |
| 2,380,101 | 7/1945 | Engelhart | 239/230 |
| 3,653,597 | 4/1972 | Blass | 239/204 |
| 3,813,043 | 5/1974 | Mordchai | 239/570 X |

*Primary Examiner*—John J. Love
*Attorney, Agent, or Firm*—Ladas, Parry, Von Gehr, Goldsmith & Deschamps

[57] ABSTRACT

A rotary water sprinkler comprising a central supply coupling, a housing articulatedly rotatable about said coupling, an outflow nozzle fixedly mounted with respect to said housing, an orifice defining member fixedly located in and with respect to said housing and defining therewith an inlet zone and a controlled pressure zone in communication with said nozzle, and separated from the inlet zone by said orifice defining member, a tubular control member fixedly mounted with respect to said coupling and communicating therewith at one open end, a valve head of said control member formed integrally with an opposite closed end thereof and located adjacent an orifice defined by said orifice defining member, the latter being axially slidable with respect to the control member, a wall portion of said tubular control member defining, at an intermediate position thereof, an aperture serving to effect communication between said inlet zone and, via the interior of the control member, with said coupling, biasing means acting on said orifice defining member so as to bias said valve head and said orifice away from one another so as to increase the through-flow cross-sectional area through said orifice, the arrangement being such that water pressure exerted on at least one of said members as a result of water flow from said coupling to said nozzle is directed opposite to said biasing means so as to reduce the through-flow cross-sectional area through said orifice.

5 Claims, 1 Drawing Figure

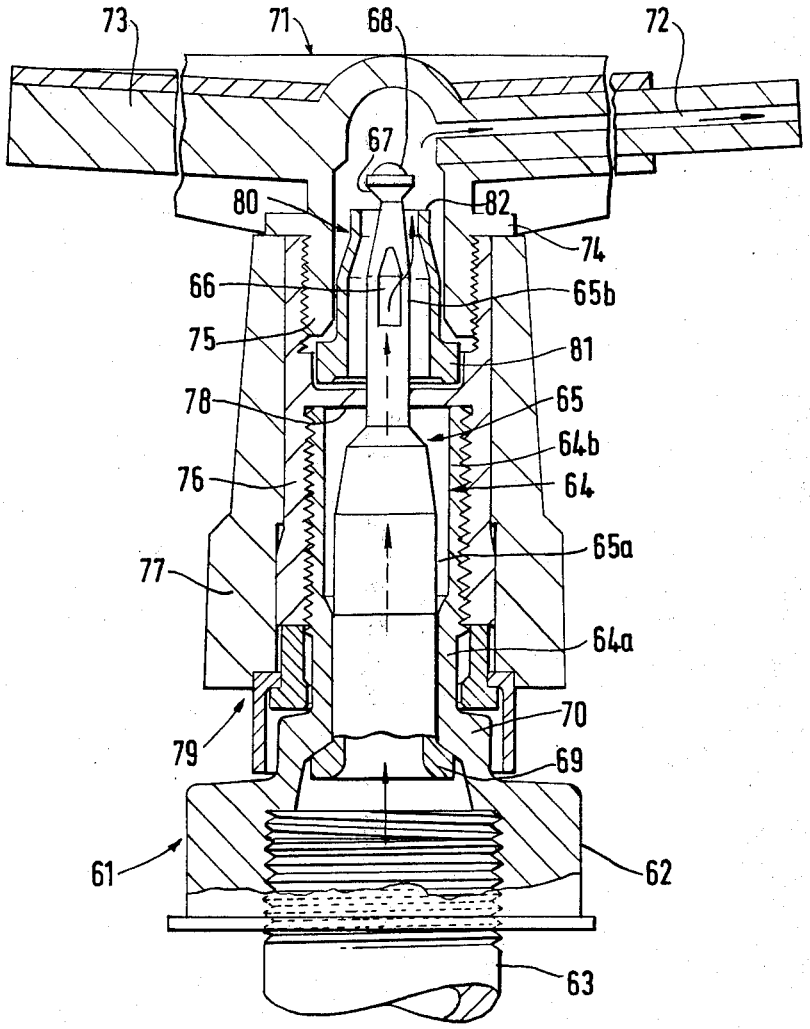
73
71
68
72
67
80
82
74
66
65b
75
81
78
65
64b
76
64
65a
77
64a
70
79
69
61
62
63

ROTARY WATER SPRINKLER

This is a continuation of application Ser. No. 553,581 filed Dec. 17, 1974 now abandoned.

This invention relates to a rotary water sprinkler of the kind having a housing articulatedly rotatable about a central supply coupling with an outflow nozzle fixedly mounted with respect to the housing, the coupling being generally screw coupled to a supply pipe. With such rotary water sprinklers, the housing and in consequence, the outflow nozzle or nozzles rotate continuously or intermittently as water flows under pressure from the supply through the nozzle and, in consequence a circular area, the centre of which is constituted by the sprinkler is sprayed.

It will be appreciated that the magnitude of this circular area is determined primarily by the outflow pressure from the nozzle or nozzles and variations in this outflow pressure lead to variations in this magnitude. Such variations can be particularly disturbing when a network of sprinklers is employed, each constituent sprinkler being arranged to spray a specific area. A direct cause of such variations in output pressures, is of course variations in the inflow pressures of the supply water and such variations can arise out of variations in the supply pressure in the mains or, for example, variations in ground level.

It is an object of the present invention therefore to provide a rotary water sprinkler having means so as to reduce to a minimum the variations in outflow pressure.

According to the present invention there is provided, in a rotary water sprinkler, the improvement comprising a central supply coupling, a housing articulatedly rotatable about said coupling, an outflow nozzle fixedly mounted with respect to said housing, an orifice defining member fixedly located in and with respect to said housing and defining therewith an inlet zone and a controlled pressure zone in communication with said nozzle, and separated from the inlet zone by said orifice defining member, a tubular control member fixedly mounted with respect to said coupling and communicating therewith at one open end, a valve head of said control member formed integrally with an opposite closed end thereof and located adjacent an orifice defined by said orifice defining member, the latter being axially slidable with respect to the control member, a wall portion of said tubular control member defining, at an intermediate position thereof, an aperture serving to effect communication between said inlet zone and, via the interior of the control member, with said coupling, biasing means acting on said orifice defining member so as to bias said valve head and said orifice away from one another so as to increase the throughflow cross-sectional area through said orifice, the arrangement being such that water pressure exerted on at least one of said members, as a result of water flow from said coupling to said nozzle, is directed opposite to said biasing means so as to reduce the through-flow cross-sectional area through said orifice.

For a better understanding of the present invention and to show how the same may be carried out in practice reference will not be made to the accompanying drawing which is a longitudinally sectioned view of a rotary water sprinkler in accordance with the present invention.

As seen in the drawing a central supply coupling collar 61 is provided with an internally threaded, base portion 62 to which is screw coupled a supply pipe riser 63. Formed integrally with the base portion 62 is an upwardly directed tubular portion 64 having a lower axial section **64*a* thereof of a reduced internal diameter as compared with the upper axial section 64*b* thereof. A tubular control member 65 is constituted of a lower axial portion 65*a* of relatively wide internal diameter and an upper axial portion 65*b* of relatively narrow internal diameter the latter portion having formed therein an axial outlet aperture 66. The upper axial portion 65*b* merges via a narrow neck 67 with an outwardly tapering valve head 68.**

The lowermost outer axial portion of the portion **65*a* is of slightly larger outer diameter and as such is force fitted within the lower section 64*a* of the tubular portion 64, a lower outwardly flanged end 69 thereof abutting an inner shoulder 70 of the tubular portion 64.**

A housing 71 is formed integrally with a tubular outlet nozzle 72 which communicates with the interior of the housing and, diametrically opposed thereto a balancing vane 73. Downwardly extending from the housing 71 and merging therewith via an outwardly flanged shoulder 74 is an externally threaded skirt member 75 which is screw coupled to a cylindrical sleeve 76 which forms a force fit within a cylindrical weighted member 77. The cylindrical sleeve 76 is formed at an intermediate inner position thereof with an annular flanged shoulder 78 through which extends slidably the upper axial portion **65*b* of the tubular control member 65. The lower end of the sleeve 76 is formed integrally with a pair of collar members 79.**

An open ended tubular sleeve 80 surrounds the control member 65 and has a lower outwardly flanged rim 81 located between the flanged shoulder 78 and the end of the skirt member 75. The upper rimmed edge 82 of the sleeve 80 constitutes an orifice defining member.

In use and with the coupling collar 62 screw coupled to the supply riser 63, the housing 71 together with the orifice defining member constituted by the rimmed edge 82 of the sleeve 80 are biased downwardly under gravity by virtue of the weighted member 77. In this position water emerging from the supply conduit 63 flows up through the control member 65 out of the orifice into the region defined between the control member 65 and the surrounding sleeve 80 and out of the orifice defined between the valve head 68 and the rim 82 into a controlled pressure region and from there out of the outlet nozzle 72.

Any untoward rise in the input pressure results in the rising of the housing 71 together with the weighted member 77 against gravity and the consequent approaching of the rim 82 to the valve member 68 and the consequent narrowing of the through flow cross-section into the controlled pressure zone. In this way untoward input pressure variations are compensated for and the pressure in the controlled pressure zone and in consequence the outflow pressure is maintained relatively constant.

I claim:

1. In a rotary water sprinkler, the improvement comprising a central supply coupling, a housing articulatedly rotatable about said coupling, an outflow nozzle fixedly mounted with respect to said housing, an orifice defining member fixedly located in and with respect to said housing and defining therewith an inlet zone and a controlled pressure zone in communication with said nozzle, and separated from the inlet zone by said orifice defining member, a tubular control member fixedly mounted with respect to said coupling and communicating therewith at one open end, a valve head of said control member formed integrally with an opposite closed end thereof and located adjacent an orifice defined by said orifice defining member, the latter being axially slidable with respect to the control member, a wall portion of said tubular control member defining, at an intermediate position thereof, an aperture serving to effect communication between said inlet zone and, via the interior of the control member, with said coupling, biasing means acting on said orifice defining member so as to bias said valve head and said orifice away from one another so as to increase the through-flow cross-sectional area through said orifice, the arrangement being such that water pressure exerted on at least one of said members as a result of water flow from said coupling to said nozzle is directed opposite to said biasing means so as to reduce the through-flow cross-sectional area through said orifice.

2. The improvement according to claim 1 wherein said biasing means is constituted by a weighted member with said housing means.

3. The improvement according to claim 1 wherein the open end of said tubular rod is constituted by a relatively large diameter skirt which is force fitted within said coupling.

4. The improvement according to claim 1 wherein said orifice defining member is constituted by an annularly flanged end portion of a sleeve which is mounted within said housing.

5. The improvement according to claim 1 wherein said valve head is of tapering cross section, having a narrowest portion adjacent said orifice and a widest portion remote from said orifice.

* * * * *

UNITED STATES PATENT OFFICE

CERTIFICATE OF CORRECTION

Patent No. 3,999,711 Dated December 28, 1976

Inventor(s) Oded Katzman et al.

It is certified that error appears in the above-identified patent and that said Letters Patent are hereby corrected as shown below:

On the cover sheet and the sheet of drawing, the drawing figure should appear as shown on the attached sheet.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*

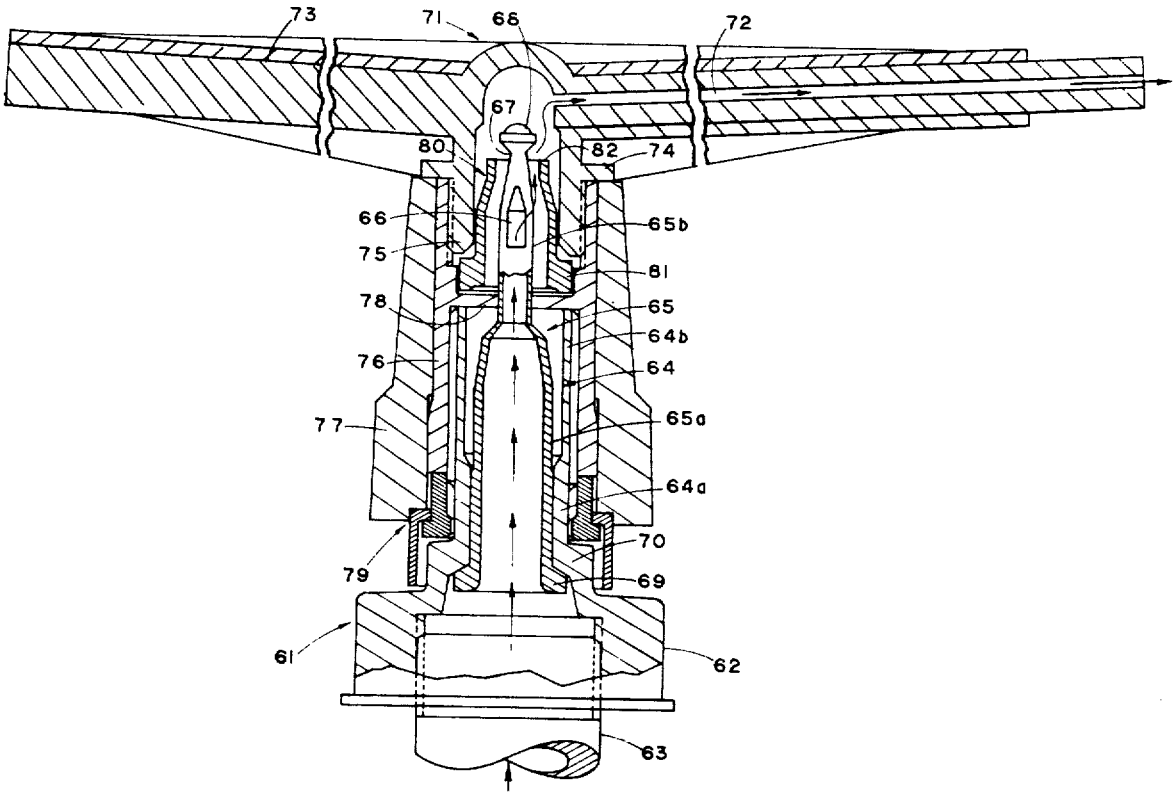
73
71
68
72
67
80
82
74
66
65b
75
81
78
65
64b
76
64
77
65a
64a
70
79
69
61
62
63